US010586481B2

(12) United States Patent
Li et al.

(10) Patent No.: US 10,586,481 B2
(45) Date of Patent: Mar. 10, 2020

(54) HIDING INFORMATION IN AN IMAGE

(71) Applicant: INTERNATIONAL BUSINESS MACHINES CORPORATION, Armonk, NY (US)

(72) Inventors: Xiaoyu Li, Beijing (CN); Wenzhe Shi, Beijing (CN); Qian Zhang, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 533 days.

(21) Appl. No.: 14/800,860

(22) Filed: Jul. 16, 2015

(65) Prior Publication Data

US 2016/0035316 A1 Feb. 4, 2016

(30) Foreign Application Priority Data

Jul. 31, 2014 (CN) ..... 2014 1 0373299

(51) Int. Cl.
*G09G 3/20* (2006.01)

(52) U.S. Cl.
CPC ..... *G09G 3/20* (2013.01); *G09G 2300/0452* (2013.01); *G09G 2358/00* (2013.01)

(58) Field of Classification Search
None
See application file for complete search history.

(56) References Cited

U.S. PATENT DOCUMENTS

| | | | |
|---|---|---|---|
| 7,352,374 | B2 | 4/2008 | Brown et al. |
| 8,369,568 | B2 | 2/2013 | Agaian et al. |
| 8,704,847 | B2 | 4/2014 | Higgins et al. |

(Continued)

FOREIGN PATENT DOCUMENTS

| | | | |
|---|---|---|---|
| CN | 1632860 | A | 12/2004 |
| CN | 101110429 | A | 1/2008 |
| KR | 20030034324 | A | 10/2001 |

OTHER PUBLICATIONS

Gupta, et al., "Enhanced Least Significant Bit Algorithm For Image Steganography," IJCEM International Journal of Computational Engineering & Management, vol. 15, Issue 4, Jul. 2012, pp. 40-42.

(Continued)

*Primary Examiner* — Aaron M Richer
(74) *Attorney, Agent, or Firm* — Steven Chiu, Esq.; Wayne F. Reinke, Esq.; Heslin Rothenberg Farley & Mesiti P.C.

(57) ABSTRACT

Embodiments of the present invention provide for hiding information in an image. A first pixel point and a second pixel point that are adjacent in an image are extracted. A first sub-pixel of the first pixel point and a second sub-pixel of the second pixel point that are to be combined during display on a display device are determined, wherein the display device determines a combined pixel value according to pixel values of the first sub-pixel and the second sub-pixel in a predefined manner. Information is hidden using parity properties of a sum of pixel values of the first sub-pixel and the second sub-pixel while the combined pixel value determined according to pixel values of the first sub-pixel and the second sub-pixel in the predefined manner is kept unchanged. By using unique display characteristics of a display device, information is hidden in an image without changing display effect of the image on the display device.

20 Claims, 4 Drawing Sheets

(56) References Cited

U.S. PATENT DOCUMENTS

| | | | | |
|---|---|---|---|---|
| 9,495,728 | B2 | 11/2016 | Chao | |
| 2003/0149879 | A1* | 8/2003 | Tian | G06T 1/0028 713/176 |
| 2004/0196297 | A1* | 10/2004 | Elliott | G06F 3/14 345/613 |
| 2006/0023880 | A1* | 2/2006 | Seroussi | G06T 1/0028 380/203 |
| 2006/0120558 | A1 | 6/2006 | Shi et al. | |
| 2007/0040952 | A1 | 2/2007 | Roh et al. | |
| 2013/0077817 | A1* | 3/2013 | Naparstek | G06F 21/6209 382/100 |
| 2013/0120437 | A1 | 5/2013 | Bajaj et al. | |
| 2014/0035971 | A1 | 2/2014 | Elliot | |

OTHER PUBLICATIONS

Chen et al., "A Module-Based LSB Substitution Method with Lossless Secret Data Compression," Computer Standards & Interfaces 33, Jan. 2011, pp. 367-371.

* cited by examiner

HIDING INFORMATION IN AN IMAGE

This application claims priority from Chinese patent application number 201410373299.5, filed Jul. 31, 2014, which is hereby incorporated herein by reference in its entirety.

BACKGROUND

Embodiments of the present invention relate to the field of hiding information, and more specifically, to hiding information on the basis of display characteristics of a display device.

Information hiding techniques have a long history, which typically hide secret information in carrier information and then pass the secret information by publishing the carrier information.

Images are common carrier information, where various information like copyright information, photo shooting parameters information, anti-counterfeiting information and so on can be hidden.

In the prior art, secret information is embedded into the least significant bit of carrier image pixel values by a LSB (least significant bit) algorithm. Using this method, the impact on the carrier image quality is minimized while information is hidden. The LSB algorithm comprises the following basic steps: converting decimal data where secret information is hidden into binary data; replacing the least significant bit of corresponding carrier data by each bit information in the binary secret information; and converting the resulting binary data that contains the secret information into pixel values, thereby obtaining an image containing the secret information. However, this hide mode in the prior art is still lossy and will inevitably change the image display, especially in some particular cases, for example, in an image with a large area of monocolor, this mode will significantly change the image display effect and lead to usage inconvenience.

SUMMARY

According to a first aspect of the present invention, there is provided a method for hiding information in an image. The method may include: extracting a first pixel point and a second pixel point that are adjacent in an image; determining a first sub-pixel of the first pixel point and a second sub-pixel of the second pixel point that are to be combined during display on a display device, wherein the display device determines a combined pixel value according to pixel values of the first sub-pixel and the second sub-pixel in a predefined manner; and hiding information using parity properties of a sum of pixel values of the first sub-pixel and the second sub-pixel while the combined pixel value determined according to pixel values of the first sub-pixel and the second sub-pixel in the predefined manner is kept unchanged.

In one aspect, the display device is a Pentile display device.

According to a second aspect of the present invention, there is provided an apparatus for hiding information in an image. The apparatus may include: a first extracting module configured to extract a first pixel point and a second pixel point that are adjacent in an image; a first determining module configured to determine a first sub-pixel of the first pixel point and a second sub-pixel of the second pixel point that are to be combined during display on a display device, wherein the display device determines a combined pixel value according to pixel values of the first sub-pixel and the second sub-pixel in a predefined manner; and a hiding module configured to hide information using parity properties of a sum of pixel values of the first sub-pixel and the second sub-pixel while the combined pixel value determined according to pixel values of the first sub-pixel and the second sub-pixel in the predefined manner is kept unchanged.

According to a third aspect of the present invention, there is provided a computer program product for hiding information in an image. The computer program product includes, for instance, a computer readable storage medium readable by a processing circuit and storing instructions for execution by the processing circuit for performing a method. The method includes, for instance, extracting a first pixel point and a second pixel point that are adjacent in an image; determining a first sub-pixel of the first pixel point and a second sub-pixel of the second pixel point that are to be combined during display on a display device, wherein the display device determines a combined pixel value according to pixel values of the first sub-pixel and the second sub-pixel in a predefined manner; and hiding information using parity properties of a sum of pixel values of the first sub-pixel and the second sub-pixel while the combined pixel value determined according to pixel values of the first sub-pixel and the second sub-pixel in the predefined manner is kept unchanged.

According to a fourth aspect of the present invention, there is provided a method for extracting information hidden in an image. The method may include: extracting a first pixel point and a second pixel point that are adjacent in an image; determining a first sub-pixel of the first pixel point and a second sub-pixel of the second pixel point that are to be combined during display on a display device; and recovering hidden information according to parity properties of a sum of the first sub-pixel value and the second sub-pixel value.

According to a fifth aspect of the present invention, there is provided an apparatus for extracting information hidden in an image. The apparatus may include: a second extracting module configured to extract a first pixel point and a second pixel point that are adjacent in an image; a second determining module configured to determine a first sub-pixel of the first pixel point and a second sub-pixel of the second pixel point that are to be combined during display on a display device; and a recovering module configured to recover hidden information according to parity properties of a sum of the first sub-pixel value and the second sub-pixel value.

According to a sixth aspect of the present invention, there is provided a computer system for hiding information in an image. The computer system includes a memory and a processor in communications with the memory, and the computer system is configured to perform a method. The method includes, for instance, extracting a first pixel point and a second pixel point that are adjacent in an image; determining a first sub-pixel of the first pixel point and a second sub-pixel of the second pixel point that are to be combined during display on a display device, wherein the display device determines a combined pixel value according to pixel values of the first sub-pixel and the second sub-pixel in a predefined manner; and hiding information using parity properties of a sum of pixel values of the first sub-pixel and the second sub-pixel while the combined pixel value determined according to pixel values of the first sub-pixel and the second sub-pixel in the predefined manner is kept unchanged.

As will be understood from the following description, image display effect is not changed while hiding information in the image. In one or more embodiments, by using unique display characteristics of a display device, such as a Pentile display device, information is hidden in an image without changing display effect of the image on the display device.

BRIEF DESCRIPTION OF THE DRAWINGS

Through the more detailed description of some embodiments of the present disclosure in the accompanying drawings, the above and other objects, features and advantages of aspects of the present disclosure will become more apparent, wherein the same reference generally refers to the same components in the embodiments of the present disclosure.

DETAILED DESCRIPTION

Some embodiments will be described in more detail with reference to the accompanying drawings, in which embodiments of the present disclosure have been illustrated. However, the present disclosure can be implemented in various manners, and thus should not be construed to be limited to the embodiments disclosed herein. On the contrary, those embodiments are provided for a thorough and complete understanding of the present disclosure, and completely conveying the scope of aspects of the present disclosure to those skilled in the art.

Figure 1:
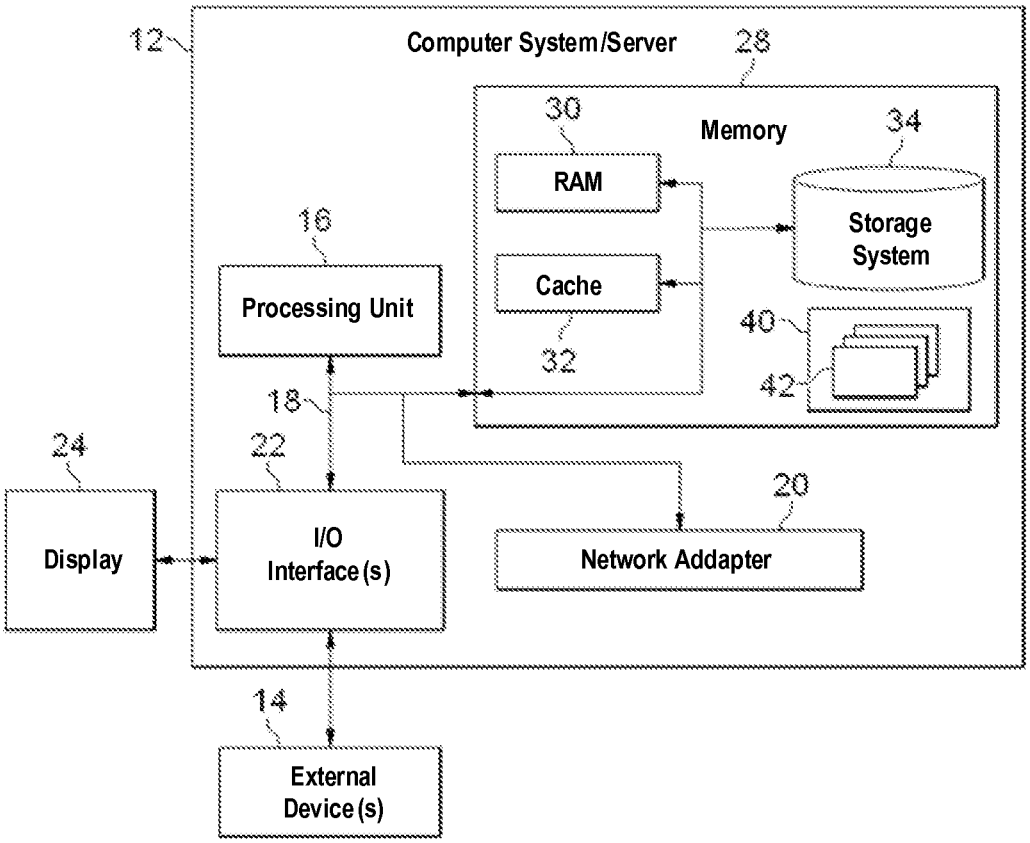
FIG. 1 schematically shows an example computer system/server 12 which is applicable to implement the embodiments of the present invention.

Referring now to FIG. 1, in which an example computer system/server 12 which is applicable to implement the embodiments of the present invention is shown. Computer system/server 12 is only illustrative and is not intended to suggest any limitation as to the scope of use or functionality of embodiments of the invention described herein.

As shown in FIG. 1, computer system/server 12 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media may be any available media that is accessible by computer system/server 12, and it includes both volatile and non-volatile media, removable and non-removable media.

System memory 28 may include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
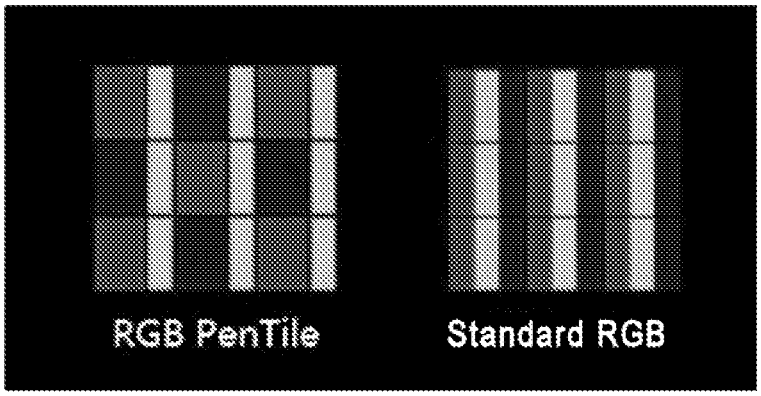
FIG. 2 shows a schematic view of a comparison of pixel appearances using Pentile arrangement and standard RGB (red, green, blue) arrangement.

Common arrangement modes for display devices include a Pentile arrangement and a standard RGB arrangement. FIG. 2 shows a schematic view of a comparison of pixel appearances using the Pentile arrangement and the standard RGB arrangement. As seen from FIG. 2, sub-pixels in the standard RGB arrangement mode have an equal light-emitting area, i.e., pixel points of the standard RGB arrangement are composed of three equal-sized sub-pixels of red, green and blue. Sub-pixels of the Pentile arrangement have different light-emitting areas, and typically the respective area of red and blue sub-pixels is twice as large as the area of the green sub-pixel. As learned by those skilled in the art, only three primary colors can constitute all colors, and two colors cannot constitute all colors. Thus, when actually displaying an image, one pixel point in the Pentile display device will "borrow" another color of its adjacent pixel points to constitute three primary colors. That is, in the horizontal direction, each pixel and adjacent pixels share sub-pixels in colors they do not have. By sharing sub-pixels with adjacent pixels, the Pentile arrangement reduces the number of sub-pixels, and thus, reduces the process difficulty and decreases the cost.

Figure 3:
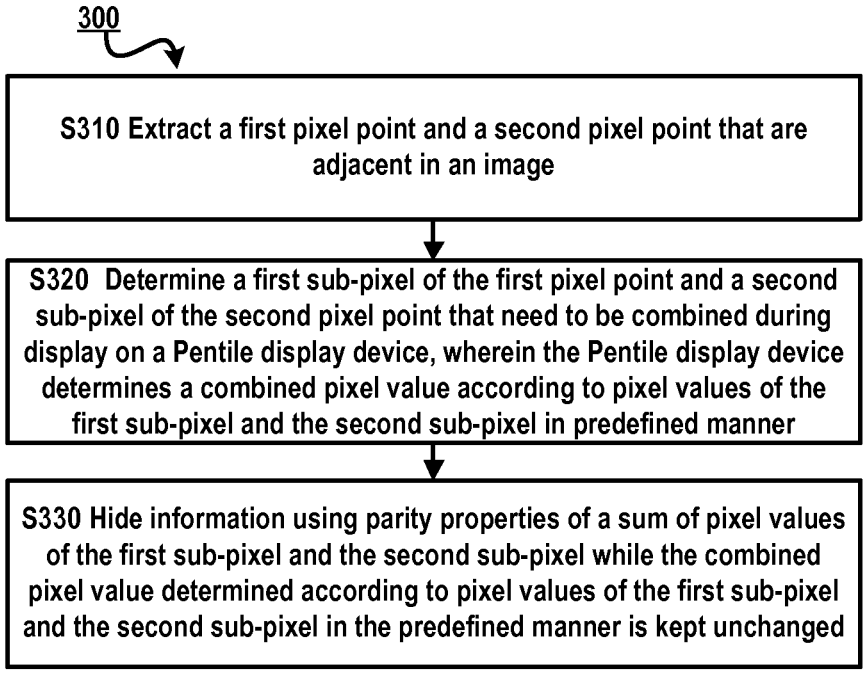
FIG. 3 shows a schematic flowchart of a method 300 for hiding information in an image according to one embodiment of the present invention.

FIG. 3 shows a schematic flowchart of a method 300 for hiding information in an image according to one embodiment of the present invention.

In step S310, a first pixel point and a second pixel point that are adjacent in an image are extracted.

As is clear to those skilled in the art, pixel points of an image comprise the RGB three primary colors, and each primary color on a single pixel point is one "sub-pixel." Take RGB24 for example. The pixel value of one pixel is represented using 24-bit binary data, the pixel value of each sub-pixel is represented in 8 bits with a value range between 0 and 255, and three sub-pixels can be combined to generate more than 16,770 colors. When displaying an image, how to drive, by a display device, a pixel point on the display device according to the pixel value of a sub-pixel of the corresponding pixel point belongs to the prior art and is not detailed here.

The image involved in this step may be a raw image. Examples of a raw image are, for example, a BMP (Bitmap) format and a RAW format. Take BMP for example. The BMP image divides an image into grids, each point of the grid is referred to as a pixel, and each pixel has its own RGB value. A concrete structure of the BMP file format includes a bitmap file header, a bitmap information header and image data.

The image involved in this step may further be a losslessly compressed image. The reason is that information hidden in an image will be impaired if the image has undergone lossy compression. The losslessly compressed image is, for example, a PNG (Portable Network Graphics) format and losslessly compressed TIF (Tagged Image File) format. For the losslessly compressed image, decompression is to be applied and then pixel extraction is performed.

To be adjacent in this step is bilaterally adjacent, because usually bilaterally adjacent pixel points in the Pentile display device have shared sub-pixels. Since there may further be a Pentile display device having shared sub-pixels along another direction, aspects of the present invention are not intended to exclude other adjacency modes, such as pixel points that are vertically adjacent.

How to extract adjacent pixel points and corresponding sub-pixels in the image can be achieved easily and thus is not detailed here.

In step S320, a first sub-pixel of the first pixel point and a second sub-pixel of the second pixel point that are to be combined during display on, e.g., a Pentile display device are determined, wherein the Pentile display device determines a combined pixel value according to pixel values of the first sub-pixel and the second sub-pixel in a predefined manner.

According to principles of the Pentile display device, adjacent pixels have shared sub-pixels. Therefore, a first sub-pixel of the first pixel point and a second sub-pixel of the second pixel point that are to be combined during display on the Pentile display device are determined. For different display panels, combination modes for sub-pixels of adjacent pixel points may differ, such as a combination of sub-pixels R, a combination of sub-pixels G, and a combination of sub-pixels B.

The Pentile display device determines a combined pixel value according to pixel values of the first sub-pixel and the second sub-pixel in the predefined manner. Since pixel values used for driving the display device are integers, the predefined manner means that the Pentile display device determines a combined pixel value of an integer according to an average value of pixel values of the first sub-pixel and the second sub-pixel. Different Pentile display devices might adopt different predefined manners for determining integers, including, without limitation to, round up or round down. Take round down as an example. The combined sub-pixel value is determined according to an average value of two sub-pixel values before combination. If the average value is an integer, then it is directly used as the pixel value of the shared sub-pixel. If the average value is not an integer, then it is rounded down to obtain a value as the pixel value of the shared sub-pixel. Suppose the two original pixel values are 50 and 150 respectively, then the combined new pixel value is their average value that equals 100. Suppose the two original pixel values are 51 and 150 respectively, then the combined new pixel value is still 100 which results from rounding down their average value 100.5.

In step S330, information is hidden using parity properties of a sum of pixel values of the first sub-pixel and the second sub-pixel while the combined pixel value determined according to pixel values of the first sub-pixel and the second sub-pixel in the predefined manner is kept unchanged.

Based on principles of the display device of the Pentile arrangement described above, no matter how sub-pixel values of the first sub-pixel and the second sub-pixel are modified, as long as the combined pixel value determined in the predefined mode is kept unchanged, the combined pixel value of the corresponding sub-pixel in the driver display will not change, so that the modified image will not change in the Pentile display device when displayed.

In one embodiment of the present invention, when hiding information using parity properties of the sum, usually information in a binary format is hidden.

In one embodiment of the present invention, a first status of the binary bit is represented using an even property of the sum; and a second status of the binary bit is represented using an odd property of the sum.

Specifically, in this embodiment, the representing the first status of the binary bit using the even property of the sum may include: keeping the first sub-pixel value and the second sub-pixel value unchanged in response to the sum being even; and modifying at least one of the first sub-pixel value and the second sub-pixel value so as to change a sum total to an even number in response to the sum being odd. In one embodiment, according to the type of the concrete predefined manner, for example, rounding up or rounding down an average value of the first and second sub-pixel values, any one of the first sub-pixel value and the second sub-pixel value is plus or minus one odd number, for example, plus or minus 1. Based thereon, those skilled in the art can conceive of an appropriate approach to modifying pixel values so that the combined pixel value determined according to the sum of modified pixel values is kept unchanged.

In this embodiment, the representing the second status of the binary bit using an odd property of the sum may include: keeping the first sub-pixel value and the second sub-pixel value unchanged in response to the sum being odd; and modifying at least one of the first sub-pixel value and the second sub-pixel value to change a sum total to an odd number in response to the sum being even. In one embodiment, according to the type of the concrete predefined manner, any one of the first sub-pixel value and the second sub-pixel value is plus or minus one odd number, for example, plus or minus 1.

In one embodiment, when the first status is binary "0," the second status is binary "1," or vice versa. In one specific example, suppose information "3" is to be hidden. First it may be converted into an 8-bit binary number 00000011, and then an odd property of a sum of pixel values of sub-pixels shared among 8 groups of adjacent pixels of the image is modulated so as to be consistent with the 8-bit binary number converted from the information "3."

In another embodiment, the first and second pixel values may be modified by a small margin. For example, by adding or deducting 1, the image where information is hidden will not change significantly when displayed on a standard RGB display device and does not change at all on a display of Pentile type.

The modification may further select the first and second pixel values to change significantly so that the image changes significantly when displayed on an ordinary RGB display device. For example, by increasing the first pixel value by 11 and decreasing the second pixel value by 10, the combined pixel value will not change while adjusting parity properties of the sum of the first and second sub-pixel values, so that the image is displayed normally on a display of Pentile type but changes significantly on a traditional RGB display.

In another embodiment, in order not to affect the display effect on the Pentile display device, adjacent pixels for hiding information may further be determined according to a preset rule. Specifically, if one of the first sub-pixel value and the second sub-pixel value is maximum, then the adjacent pixel is skipped over.

Figure 4:
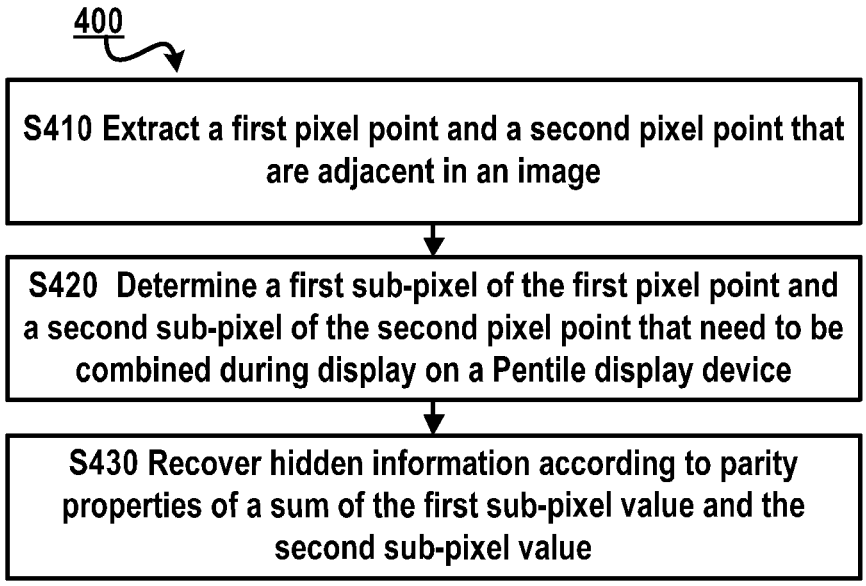
FIG. 4 shows a schematic flowchart of a method for extracting information hidden in an image using a method in FIG. 3 according to one embodiment of the present invention.

FIG. 4 shows a schematic flowchart view of a method for extracting information hidden in an image according to the method in FIG. 3. The method shown in FIG. 4 includes, for example:

In step 410, extracting a first pixel point and a second pixel point that are adjacent in an image;

In step 420, determining a first sub-pixel of the first pixel point and a second sub-pixel of the second pixel point that are to be combined during display on a Pentile display device; and In step 430, recovering information according to parity properties of a sum of the first sub-pixel value and the second sub-pixel value.

In one specific embodiment, the hidden information comprises at least one binary bit. Therefore, step 430 specifically includes, for instance: in response to the sum being odd, extracting a first status of the binary bit; and in response to the sum being even, extracting a second status of the binary bit.

Figure 5:
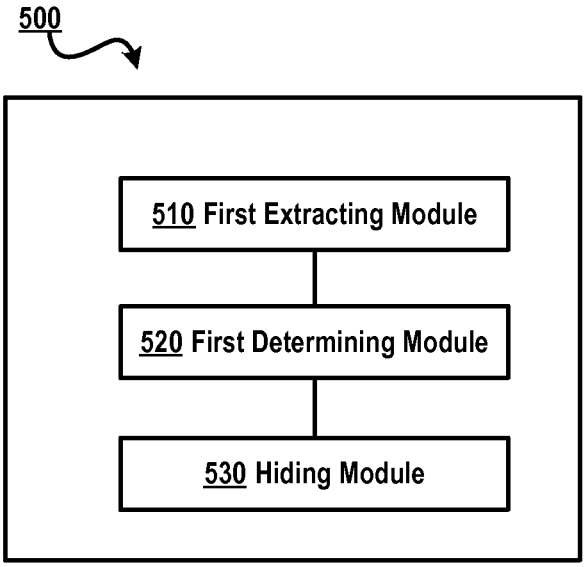
FIG. 5 shows a schematic block diagram of an apparatus 500 for hiding information in an image according to one embodiment of the present invention.

FIG. 5 shows a schematic block diagram of an apparatus 500 for hiding information in an image according to one exemplary embodiment of the present invention. According to the embodiment of the present invention, apparatus 500 may include:

a first extracting module 510 configured to extract a first pixel point and a second pixel point that are adjacent in an image;

a first determining module 520 configured to determine a first sub-pixel of the first pixel point and a second sub-pixel of the second pixel point that are to be combined during display on a display device, such as a Pentile display device, wherein the display device determines a combined pixel value according to pixel values of the first sub-pixel and the second sub-pixel in a predefined manner; and a hiding module 530 configured to hide information using parity properties of a sum of pixel values of the first sub-pixel and the second sub-pixel while the combined pixel value determined according to pixel values of the first sub-pixel and the second sub-pixel in the predefined manner is kept unchanged.

In one embodiment, the hidden information comprises at least one binary bit, and hiding module 530 includes, e.g.: a module configured to represent a first status of the binary bit using an even property of the sum; and a module configured to represent a second status of the binary bit using an odd property of the sum. In one specific embodiment, the module configured to represent the first status of the binary bit using the even property of the sum includes, e.g., a module configured to keep the first sub-pixel value and the second sub-pixel value unchanged in response to the sum being even; and a module configured to modify at least one of the first sub-pixel value and the second sub-pixel value so as to change a sum total to an even number in response to the sum being odd. In a more specific embodiment, the module configured to modify at least one of the first sub-pixel value and the second sub-pixel value so as to change the sum total to the even number in response to the sum being odd includes, for instance, a module configured to increase or decrease any one of pixel values of the first sub-pixel and the second sub-pixel by one odd number. In one embodiment, the one odd number takes a value of 1.

In another specific embodiment, the module configured to represent the second status of the binary bit using the odd property of the sum includes, for instance, a module configured to keep the first sub-pixel value and the second sub-pixel value unchanged in response to the sum being odd; and a module configured to modify at least one of the first sub-pixel value and the second sub-pixel value to change a sum total to an odd number in response to the sum being even. In another more specific embodiment, the module configured to modify at least one of the first sub-pixel value and the second sub-pixel value to change a sum total to an odd number in response to the sum being even includes e.g., a module configured to increase or decrease any one of pixel values of the first sub-pixel and the second sub-pixel by one odd number. In one embodiment, the odd number takes a value of 1.

Figure 6:
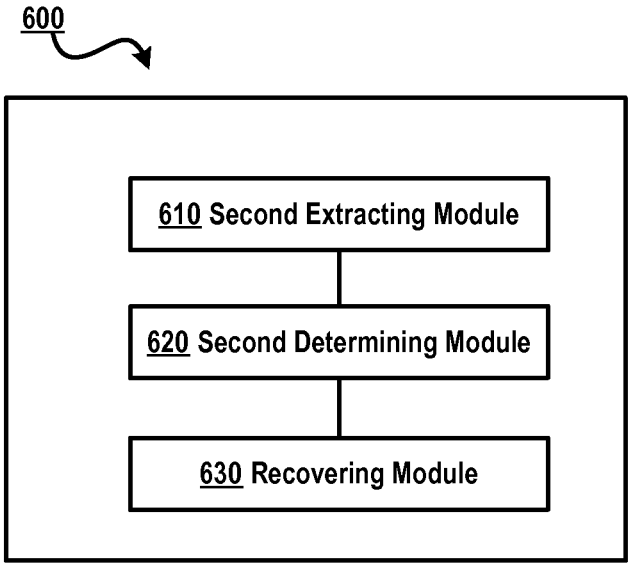
FIG. 6 shows a schematic block diagram of an apparatus 600 for extracting information hidden in an image using a method in FIG. 3 according to one embodiment of the present invention.

FIG. 6 shows a schematic block diagram of an apparatus 600 for extracting information hidden in an image according to the method in FIG. 3. Apparatus 600 includes, for example:

a second extracting module 610 configured to extract a first pixel point and a second pixel point that are adjacent in an image;

a second determining module 620 configured to determine a first sub-pixel of the first pixel point and a second sub-pixel of the second pixel point that are to be combined during display on a Pentile display device; and a recovering module configured to recover information according to parity properties of a sum of the first sub-pixel value and the second sub-pixel value.

In one embodiment, the hidden information comprises at least one binary bit. Recovering module 630 includes, for instance: a module configured to extract a first status of the binary bit in response to the sum being odd; and a module configured to extract a second status of the binary bit in response to the sum being even.

The method or apparatus of one or more aspects of the present application, when hiding information in an image, makes use of display characteristics of a display device, such as a Pentile display device, so that the Pentile display device, when displaying the image with hidden information, will not change display effect of the image.

Aspects of the present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method of hiding information in an image, comprising:

extracting a first pixel point and a second pixel point that are adjacent in an image, the first pixel point comprising a plurality of first sub-pixels and the second pixel point comprising a plurality of second sub-pixels;

determining a first sub-pixel of the plurality of first sub-pixels of the first pixel point and a second sub-pixel of the plurality of second sub-pixels of the second pixel point that are to be combined during display on a display device, wherein the display device determines a combined pixel value according to pixel values of the first sub-pixel and the second sub-pixel in a predefined manner and absent pixel values for other first sub-pixels of the plurality of first sub-pixels and pixel values for other second sub-pixels of the plurality of second sub-pixels; and hiding information using parity properties of a sum of pixel values of the first sub-pixel and the second sub-pixel, the sum of pixel values absent pixel values for other first sub-pixels of the plurality of first sub-pixels and other second sub-pixels of the plurality of second sub-pixels, wherein the combined pixel value determined according to pixel values of the first sub-pixel and the second sub-pixel in the predefined manner is kept unchanged, and the parity properties comprise odd or even, wherein the display device comprises a shared sub-pixel display device, wherein the first pixel point and the second pixel point comprise shared sub-pixels, and wherein the predefined manner comprises averaging the pixel values of the first sub-pixel and the second sub-pixel to obtain an average pixel value and, based on the average pixel value, rounding the average pixel value to obtain a same pixel value with or without the information, such that display of the image on the shared sub-pixel display device without the information displays identical to the image with the information.

2. The method according to claim 1, wherein the hidden information comprises at least one binary bit, and wherein the hiding information using parity properties of the sum comprises:

representing a first status of the at least one binary bit using an even property of the sum; and representing a second status of the at least one binary bit using an odd property of the sum.

3. The method according to claim 2, wherein the representing the first status of the at least one binary bit using the even property of the sum comprises:

keeping a first sub-pixel value and a second sub-pixel value unchanged in response to the sum being even; and modifying at least one of the first sub-pixel value and the second sub-pixel value so as to change a sum total to an even number in response to the sum being odd.

4. The method according to claim 3, wherein the modifying the at least one of the first sub-pixel value and the second sub-pixel value so as to change the sum total to the even number in response to the sum being odd comprises:

increasing or decreasing any one of pixel values of the first sub-pixel and the second sub-pixel by one odd number.

5. The method according to claim 4, wherein the odd number takes a value of 1.

6. The method according to claim 2, wherein the representing the second status of the at least one binary bit using the odd property of the sum comprises:

keeping a first sub-pixel value and a second sub-pixel value unchanged in response to the sum being odd; and modifying at least one of the first sub-pixel value and the second sub-pixel value to change a sum total to an odd number in response to the sum being even.

7. The method according to claim 6, wherein the modifying the at least one of the first sub-pixel value and the second sub-pixel value to change the sum total to the odd number in response to the sum being even comprises:

increasing or decreasing any one of pixel values of the first sub-pixel and the second sub-pixel by one odd number.

8. The method according to claim 1, further comprising extracting hidden information, the extracting comprising recovering the hidden information according to parity properties of the sum of pixel values of the first sub-pixel and the second sub-pixel.

9. The method according to claim 8, wherein the hidden information comprises at least one binary bit, and the recovering hidden information according to parity properties of the sum of the pixel values of the first sub-pixel and the second sub-pixel comprises:

extracting a first status of the at least one binary bit in response to the sum being odd; and extracting a second status of the at least one binary bit in response to the sum being even.

10. The method according to claim 1, wherein a type for the image is losslessly compressed.

11. A computer system for hiding information in an image, comprising:

a memory; and a processor in communications with the memory, wherein the computer system is configured to perform a method, said method comprising:

extracting a first pixel point and a second pixel point that are adjacent in an image, the first pixel point comprising a plurality of first sub-pixels and the second pixel point comprising a plurality of second sub-pixels;

determining a first sub-pixel of the plurality of first sub-pixels of the first pixel point and a second sub-pixel of the plurality of second sub-pixels of the second pixel point that are to be combined during display on a display device, wherein the display device determines a combined pixel value according to pixel values of the first sub-pixel and the second sub-pixel in a predefined manner and absent pixel values for other first sub-pixels of the plurality of first sub-pixels and pixel values for other second sub-pixels of the plurality of second sub-pixels; and hiding information using parity properties of a sum of pixel values of the first sub-pixel and the second sub-pixel, the sum of pixel values absent pixel values for other first sub-pixels of the plurality of first sub-pixels and other second sub-pixels of the plurality of second sub-pixels, wherein the combined pixel value determined according to pixel values of the first sub-pixel and the second sub-pixel in the predefined manner is kept unchanged, and the parity properties comprise odd or even, wherein the display device comprises a shared sub-pixel display device, and wherein the first pixel point and the second pixel point comprise shared sub-pixels, and wherein the predefined manner comprises averaging the pixel values of the first sub-pixel and the second sub-pixel to obtain an average pixel value and, based on the average pixel value, rounding the average pixel value to obtain a same pixel value with or without the information, such that display of the image on the shared sub-pixel display device without the information displays identical to the image with the information.

12. The computer system according to claim 11, wherein the hidden information comprises at least one binary bit, and wherein the hiding information using parity properties of the sum comprises:

representing a first status of the at least one binary bit using an even property of the sum; and representing a second status of the at least one binary bit using an odd property of the sum.

13. The computer system according to claim 12, wherein the representing the first status of the at least one binary bit using the even property of the sum comprises:

keeping a first sub-pixel value and a second sub-pixel value unchanged in response to the sum being even; and modifying at least one of the first sub-pixel value and the second sub-pixel value so as to change a sum total to an even number in response to the sum being odd.

14. The computer system according to claim 13, wherein the modifying the at least one of the first sub-pixel value and the second sub-pixel value so as to change the sum total to the even number in response to the sum being odd comprises:

increasing or decreasing any one of pixel values of the first sub-pixel and the second sub-pixel by one odd number.

15. The computer system according to claim 14, wherein the odd number takes a value of 1.

16. The computer system according to claim 12, wherein the representing the second status of the at least one binary bit using the odd property of the sum comprises:

keeping a first sub-pixel value and a second sub-pixel value unchanged in response to the sum being odd; and modifying at least one of the first sub-pixel value and the second sub-pixel value to change a sum total to an odd number in response to the sum being even.

17. The computer system according to claim 16, wherein the modifying the at least one of the first sub-pixel value and the second sub-pixel value to change the sum total to the odd number in response to the sum being even comprises:

increasing or decreasing any one of pixel values of the first sub-pixel and the second sub-pixel by one odd number.

18. The computer system according to claim 11, wherein the method further comprises extracting hidden information, the extracting comprising recovering the hidden information according to parity properties of the sum of pixel values of the first sub-pixel and the second sub-pixel.

19. The computer system according to claim 11, wherein a type for the image is losslessly compressed.

20. A computer program product for hiding information in an image, the computer program product comprising:

a computer readable storage medium readable by a processing circuit and storing instructions for execution by the processing circuit for performing a method comprising:

extracting a first pixel point and a second pixel point that are adjacent in an image, the first pixel point comprising a plurality of first sub-pixels and the second pixel point comprising a plurality of second sub-pixels;

determining a first sub-pixel of the plurality of first sub-pixels of the first pixel point and a second sub-pixel of the plurality of second sub-pixels of the second pixel point that are to be combined during display on a display device, wherein the display device determines a combined pixel value according to pixel values of the first sub-pixel and the second sub-pixel in a predefined manner and absent pixel values for other first sub-pixels of the plurality of first sub-pixels and pixel values for other second sub-pixels of the plurality of second sub-pixels; and hiding information using parity properties of a sum of pixel values of the first sub-pixel and the second sub-pixel, the sum of pixel values absent pixel values for other first sub-pixels of the plurality of first sub-pixels and other second sub-pixels of the plurality of second sub-pixels, wherein the combined pixel value determined according to pixel values of the first sub-pixel and the second sub-pixel in the predefined manner is kept unchanged, and the parity properties comprise odd or even, wherein the display device comprises a shared sub-pixel display device, wherein the first pixel point and the second pixel point comprise shared sub-pixels, and wherein the predefined manner comprises averaging the pixel values of the first sub-pixel and the second sub-pixel to obtain an average pixel value and, based on the average pixel value, rounding the average pixel value to obtain a same pixel value with or without the information, such that display of the image on the shared sub-pixel display device without the information displays identical to the image with the information.

* * * * *